US011136858B2

(12) United States Patent
Nguyen et al.

(10) Patent No.: US 11,136,858 B2
(45) Date of Patent: Oct. 5, 2021

(54) METHODS AND SYSTEMS FOR PACKING EXTENDED REACH WELLS USING INFLOW CONTROL DEVICES

(71) Applicants: Hang Nguyen, Magnolia, TX (US); Christophe Malbrel, Houston, TX (US)

(72) Inventors: Hang Nguyen, Magnolia, TX (US); Christophe Malbrel, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/778,719

(22) Filed: Jan. 31, 2020

(65) Prior Publication Data

US 2021/0238956 A1 Aug. 5, 2021

(51) Int. Cl.

| | |
|---|---|
| ***E21B 34/10*** | (2006.01) |
| ***E21B 43/04*** | (2006.01) |
| ***E21B 43/08*** | (2006.01) |
| ***E21B 43/267*** | (2006.01) |
| ***E21B 33/12*** | (2006.01) |

(52) U.S. Cl.
CPC ..... *E21B 34/10* (2013.01); *E21B 33/12* (2013.01); *E21B 43/04* (2013.01)

(58) Field of Classification Search
CPC ..... E21B 43/04; E21B 43/08; E21B 43/267; E21B 34/10
See application file for complete search history.

(56) References Cited

U.S. PATENT DOCUMENTS

| | | | | |
|---|---|---|---|---|
| 5,373,899 | A | 12/1994 | Dore et al. | |
| 6,581,688 | B2 | 6/2003 | Voll et al. | |
| 7,296,624 | B2 * | 11/2007 | Rodet | E21B 34/10 166/278 |
| 10,082,007 | B2 * | 9/2018 | Broussard | E21B 43/08 |
| 2002/0104650 | A1 | 8/2002 | Dusterhoft et al. | |

(Continued)

OTHER PUBLICATIONS

International Search Report, International Application No. PCT/US2021/015376, dated May 10, 2021, Korean Intellectual Property Office; International Search Report 6 pages.

(Continued)

*Primary Examiner* — Catherine Loikith
(74) *Attorney, Agent, or Firm* — Cantor Colburn LLP

(57) ABSTRACT

Systems and methods for downhole gravel packing operations. The systems include a pressure activated fluid diverter and a plurality of inflow control devices attached to the pressure activated fluid diverter to form a section of a string. The pressure activated fluid diverter has a flow performance curve defined by: $DP=AQ^3+BQ^2+CQ$, where DP is the differential pressure across the pressure activated fluid diverter in psi and Q is the flow rate through the pressure activated fluid diverter in bpm, with a fluid passing therethrough being at room temperature, having a fluid density of 9.2 ppg, and a fluid viscosity of 1 cps, the flow performance curve of the pressure activated fluid diverter is equal to or below a maximum flow performance curve defined by A=0, B=313.43, C=−1.715.

20 Claims, 9 Drawing Sheets

(56) References Cited

U.S. PATENT DOCUMENTS

| | | | |
|---|---|---|---|
| 2005/0092488 | A1 | 5/2005 | Rodet et al. |
| 2009/0159275 | A1 | 6/2009 | Kannan et al. |
| 2018/0258743 | A1 | 9/2018 | Malbrel et al. |

OTHER PUBLICATIONS

International Written Opinion, International Application No. PCT/US2021/015376, dated May 10, 2021, Korean Intellectual Property Office; International Written Opinion 5 pages.

* cited by examiner

METHODS AND SYSTEMS FOR PACKING EXTENDED REACH WELLS USING INFLOW CONTROL DEVICES

BACKGROUND

1. Field of the Invention

This invention relates generally to gravel packing wells and, more particularly, to methods for gravel packing horizontal wells and extended reach wells using inflow control devices.

2. Description of the Related Art

Boreholes are drilled deep into the earth for many applications, such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Once the boreholes have been drilled, such boreholes may require gravel packing to prevent sand or other debris from being extracted from a formation during production.

Various techniques for open hole gravel packing of oil and gas wells are well known. Highly deviated, extended reach, and horizontal wells have become more common over the past few years. Wells that include several thousand feet of horizontal section, some times greater than 6,000 feet may be drilled. Wells with such long, highly deviated or horizontal segments are referred to herein as the extended reach wells or extended reach horizontal wells. Gravel or sand, which is relatively heavy compared to a carrying fluid (e.g., salt water) has been used effectively for packing several thousand feet of a continuous section of annulus between a borehole wall and a screen used for production. The screen is typically used to support the packing material (i.e., a proppant) relative to a production screen. Lighter proppants, which may be made from a variety of synthetic materials, have also been used in packing the annulus of highly deviated wells. Extended reach open hole wells (i.e., boreholes that have not been cased) pose particular problems due to excessive friction forces over the length of such long horizontal sections. The aim is to completely pack the annulus over the entire length of the screen (i.e., packed proppant extends a full 100% of the length of the extended reach well that is packed).

Gravel packing consists of pumping of a slurry of proppant into an annular space between a gravel packing system (e.g., including a number of screens or inflow control devices ("ICDs")) and the borehole. This operation is made possible by a washpipe placed inside the gravel packing system to drive fluid flow in the annulus all the way to the end of the completion (e.g., a toe of the borehole). Typically, an ICD-based completion has a screen at the end to facilitate circulation as the slurry is pumped in the annulus at an uphole end of the gravel packing system and the gravel settles on the low side of the ICDs and progresses toward the distal end (e.g., the toe of the borehole). This phenomenon of gravel settling is called "duning" and may cover most of the screen as a dune (of the gravel) progresses along the screen (referred to as an alpha-wave).

Once the alpha-wave is complete and the dune has reached the toe (i.e., distal end) of the borehole or well, there is a small space on top of the screen that is left open until a beta-wave of proppant starts and walks backward toward the uphole end of the gravel packing system to fill the void. At that stage, the only way fluid dehydrates is by flowing inside an inlet (e.g., a screen) of the ICDs, into the washpipe/basepipe annulus toward the washpipe entry point at the toe of the well.

However, during gravel packing of an ICD-based gravel packing system, as more and more joints (ICDs) are covered by the gravel during the beta-wave, a pressure drop needed to force the fluid in, and flow it inside the washpipe to the basepipe annulus, increases. The pressure may increase up until a point where the pressure reaches a critical reservoir/formation frac pressure. At that pressure, the wellbore is no longer stable and fluid starts to be lost to the formation. This loss can lead to a bridging of proppant in the annulus and lead to premature screen-out. Further, at the frac pressure limit, operations may be stopped and several ICD joints may remain incompletely packed.

SUMMARY

Described herein are systems and methods for downhole gravel packing operations. The systems include a pressure activated fluid diverter and a plurality of inflow control devices attached to the pressure activated fluid diverter to form a section of a string. The pressure activated fluid diverter has a flow performance curve defined by: $DP=AQ^3+BQ^2+CQ$, where DP is the differential pressure across the pressure activated fluid diverter in psi and Q is the flow rate through the pressure activated fluid diverter in bpm, with a fluid passing therethrough being at room temperature, having a fluid density of 9.2 ppg, and a fluid viscosity of 1 cps, the flow performance curve of the pressure activated fluid diverter is equal to or below a maximum flow performance curve defined by A=0, B=313.43, C=−1.715.

The methods include disposing a downhole gravel packing system into the borehole, the system comprising a pressure activated fluid diverter and a plurality of inflow control devices attached to the pressure activated fluid diverter to form a section of a string, wherein the pressure activated fluid diverter has a flow performance curve defined by: $DP=AQ^3+BQ^2+CQ$, wherein DP is the differential pressure across the pressure activated fluid diverter in psi and Q is the flow rate through the pressure activated fluid diverter in bpm, and wherein, with a fluid passing therethrough being at room temperature, having a fluid density of 9.2 ppg, and a fluid viscosity of 1 cps, the flow performance curve of the pressure activated fluid diverter is equal to or below a maximum flow performance curve defined by A=0, B=313.43, C=−1.715; performing an alpha pack operation to fill a section of the borehole with a proppant from the pressure activated fluid diverter to a toe of the borehole; and performing a beta pack operation to fill the section of the borehole with the proppant from the toe back to the pressure activated fluid diverter, wherein some fluid flow is diverted through the pressure activated fluid diverter when a pressure of the fluid exceeds the flow performance curve of the pressure activated fluid diverter.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are methods and systems for performing packing operations in extended reach and horizontal wells using inflow control device (ICD)-based gravel packing systems. Such systems include a pressure activated fluid diverter that enables a fluid pressure reduction during a beta-wave operation to ensure complete packing of a section of horizontal well. The pressure activated fluid diverter may be arranged at an uphole end of the ICD-based gravel packing systems to enable diversion of fluid, as needed and prevent overpressure situations that could exceed the frac pressure limit of a formation.

Figure 1:
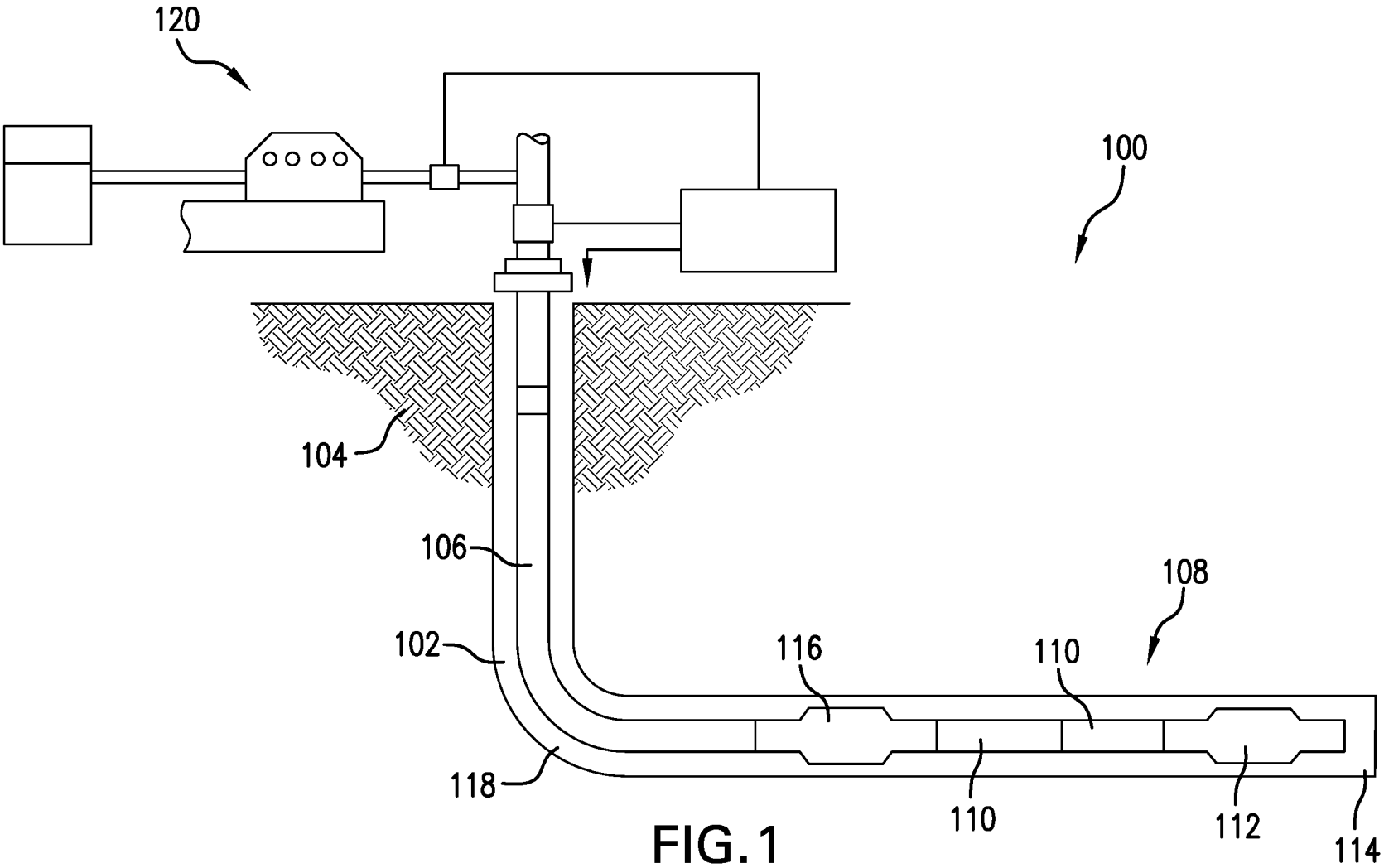
FIG. 1 depicts a system for formation stimulation and hydrocarbon production that can incorporate embodiments of the present disclosure.

Referring to FIG. 1, a schematic illustration of an embodiment of a system 100 for gravel packing a portion of a borehole 102 passing through an earth formation 104 that can employ embodiments of the present disclosure is shown. The system 100 includes a string 106 disposed within the borehole 102. The string 106, in some embodiments, includes a plurality of string segments or, in other embodiments, is a continuous conduit such as a coiled tube. As described herein, "string" refers to any structure or carrier suitable for lowering a tool or other component through a borehole, and is not limited to the structure and configuration illustrated herein. The term "carrier" as used herein means any device, device component, combination of devices, media, and/or member that may be used to convey, house, support, or otherwise facilitate the use of another device, device component, combination of devices, media, and/or member. Example, non-limiting carriers include, but are not limited to, casing pipes, wirelines, wireline sondes, slickline sondes, drop shots, downhole subs, and bottomhole assemblies.

In this illustrative embodiment, the system 100 includes a gravel packing system 108 configured to perform a completion within the borehole 102. The gravel packing system 108 includes one or more tools or components to facilitate gravel packing of the borehole 102. For example, the string 106 includes one or more screen assemblies and/or inflow control devices ("ICDs") 110 having a washpipe passing therethrough. A gravel pack screen, as will be appreciated by those of skill in the art, is a metal filter assembly or device arranged to support a proppant on an exterior of the screen and allow fluid to pass through apertures or perforations of the screen. An inflow control device (ICD), as will be appreciated by those of skill in the art, is a passive component with structure to at least partially choke flow through the ICD, and in some configurations may have a single inlet or aperture for fluid passage.

As shown, a float shoe 112 may be arranged at an end of the string 106 and, as shown, is located proximate the toe 114 of the borehole 102. The gravel packing system 108 may further include a packer 116 located at an uphole extent of a section to be gravel packed (e.g., proximate a heel 118 of a horizontal section of the borehole 102). A surface system 120 can be configured to inject sand, gravel, or other proppant into the borehole, as will be appreciated by those of skill in the art, to perform a gravel packing operation. In some embodiments, the gravel packing system 108 may be arranged within an uncased section of the borehole 102, and the packer 116 may be arranged within a cased section of the borehole 102.

As discussed above, gravel packing consists in the pumping of a slurry or proppant in the annular space between screens or inflow control devices ("ICDs") of the gravel packing system and the wellbore. This operation is made possible by a washpipe placed inside the completion to drive fluid flow in the annulus all the way to the end of the completion (e.g., to the toe of the borehole). Typically, an ICD-based completion has a screen at the end to facilitate circulation as the slurry is pumped in the annulus and the gravel settles on the low side of the ICDs. As noted above, this phenomenon of gravel settling is called "duning" and may cover most of the screen as a dune (of the gravel) progresses along the screen (referred to as an alpha-wave).

Once the alpha-wave is complete and the dune has reached the toe (i.e., distal end) of the borehole, there is a void of unfilled space within the annulus on top of the gravel packing system that is left open until a beta-wave of proppant starts and walks backward towards the uphole end of the gravel packing system to fill the void. At that stage, the only way fluid dehydrates is by flowing inside the inflow ports of the ICDs into the washpipe/base pipe annulus toward the washpipe entry point at the toe of the well.

Gradually, as more and more joints are covered by the gravel, the pressure drop needed to force the fluid in, and flow it inside the washpipe to base pipe annulus, increases. The pressure may increase up until a point where it reaches a critical reservoir frac pressure. At that pressure, the wellbore is no longer stable and the fluid starts to be lost to the formation. This loss can lead to a bridging of proppant in the annulus and lead to premature screen-out. Further, at the frac pressure limit, operations may be stopped and several ICD joints may remain incompletely packed. Accordingly, it may be advantageous to develop systems that can employ ICD-based gravel packing systems, without the risk of excessive fluid pressure build-up during a beta-wave operation.

Figure 2:
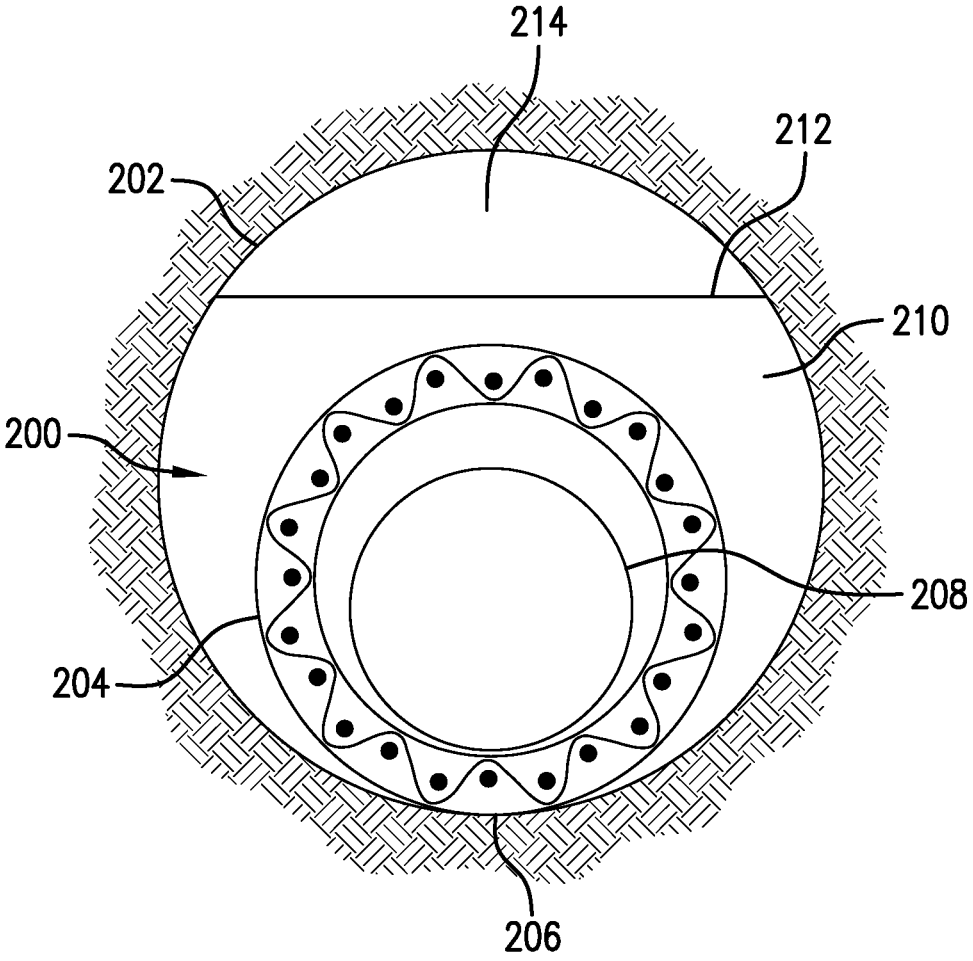
FIG. 2 depicts a cross-section of a section of borehole packed using an alpha-wave packing operation.

FIG. 2 illustrates a gravel packing system 200 within a borehole 202. FIG. 2 illustrates a dune height for an alpha-wave during a gravel pack operation (e.g., a wave of proppant traveling downhole (from heel to toe) to fill the annulus). As shown, the gravel packing system 200 includes a screen or inflow control device ("ICD") 204 that is placed along a length of a horizontal section of borehole 202. In this configuration, as illustrated, no centralizer is used to arrange the ICD 204 in a center of the borehole 202. As such, the ICD 204 is shown lying on a bottom section 206 of the borehole 202. A washpipe 208 is arranged inside the ICD 204 to provide a return path for a clean fluid, as will be appreciated by those of skill in the art. An annulus 210 of the borehole 202 between the ICD 204 and a wall of the borehole 202 must be fully (i.e., one hundred percent (100%)) packed with a selected proppant that is pumped or injected downhole. An alpha-wave dune height 212 is shown. A beta-wave operation is employed to fill a void 214 of the annulus 210 with the proppant (from toe to heel). However, as noted above, when using an ICD-based gravel packing systems, complete packing and fill may be difficult to achieve due to pressure concerns, specifically excessive pressure build up that meets or exceeds the frac pressure limit.

To alleviate the pressure build up when using ICD-based gravel packing system, in accordance with embodiments of the present disclosure, a pressure activated fluid diverter is arranged at the uphole end of the gravel packing system. In some embodiments, the pressure activated fluid diverter may be positioned inside a casing (e.g., proximate the heel or other starting point of a section to be packed) and uphole from an uncased section of borehole to be packed. During the pumping of the alpha-wave, the pressure activated fluid diverter is not activated because the path of least resistance for the proppant is through the annulus around the exterior of the ICD-based gravel packing system. This results in the proppant to naturally dune toward the toe of the well during the alpha-wave operation. However, once the alpha-wave is complete, and the beta-wave begins (i.e., in the opposite direction, such as, from toe to heel), a pressure differential across the pressure activated fluid diverter increases and fluid flow is directed toward the annular space between the washpipe and the ICDs (i.e., within the string itself). This diversion of fluid will reduce the fluid pressure on the wellbore walls and allow the beta-wave to progress back to the starting point (e.g., heel) while remaining below the frac pressure of the formation. Thus, by diverting a portion of the flow during the beta-wave propagation, the beta-wave may travel the full length of the ICD-based gravel packing system and thus a complete packing may be achieved.

It is noted that a typical screen arranged at the top of the packing section would not restrict flow enough to reduce flow and would permit too much fluid loss through the screen, the proppant or other slurry would dehydrate too rapidly and bridging would occur before the gravel pack is complete. That is, a screen-based solution will divert too much flow at the heal of the well during the beta wave and induce early screen out as the fluid would filter out the proppant that would bridge inside the casing and leave a large section of the open hole without beta wave.

The pressure activated fluid diverter of embodiments of the present disclosure may be an ICD with a flowrate-for-a-given-fluid-pressure that is that is greater (potentially significantly greater) than the flowrate-for-a-given-fluid-pressure of other ICDs of an ICD-based gravel packing system. For example, embodiments of the present disclosure may include a pressure activated fluid diverter arranged uphole from a set of ICDs of an ICD-based gravel packing system. The pressure activated fluid diverter may be configured with a flowrate-for-a-given-fluid-pressure that is at least one or two orders of magnitude more than that of the remaining ICDs of the ICD-based gravel packing system (i.e. a greater flowrate is achieved with the pressure activated fluid diverter for a given fluid pressure).

Figure 3A:
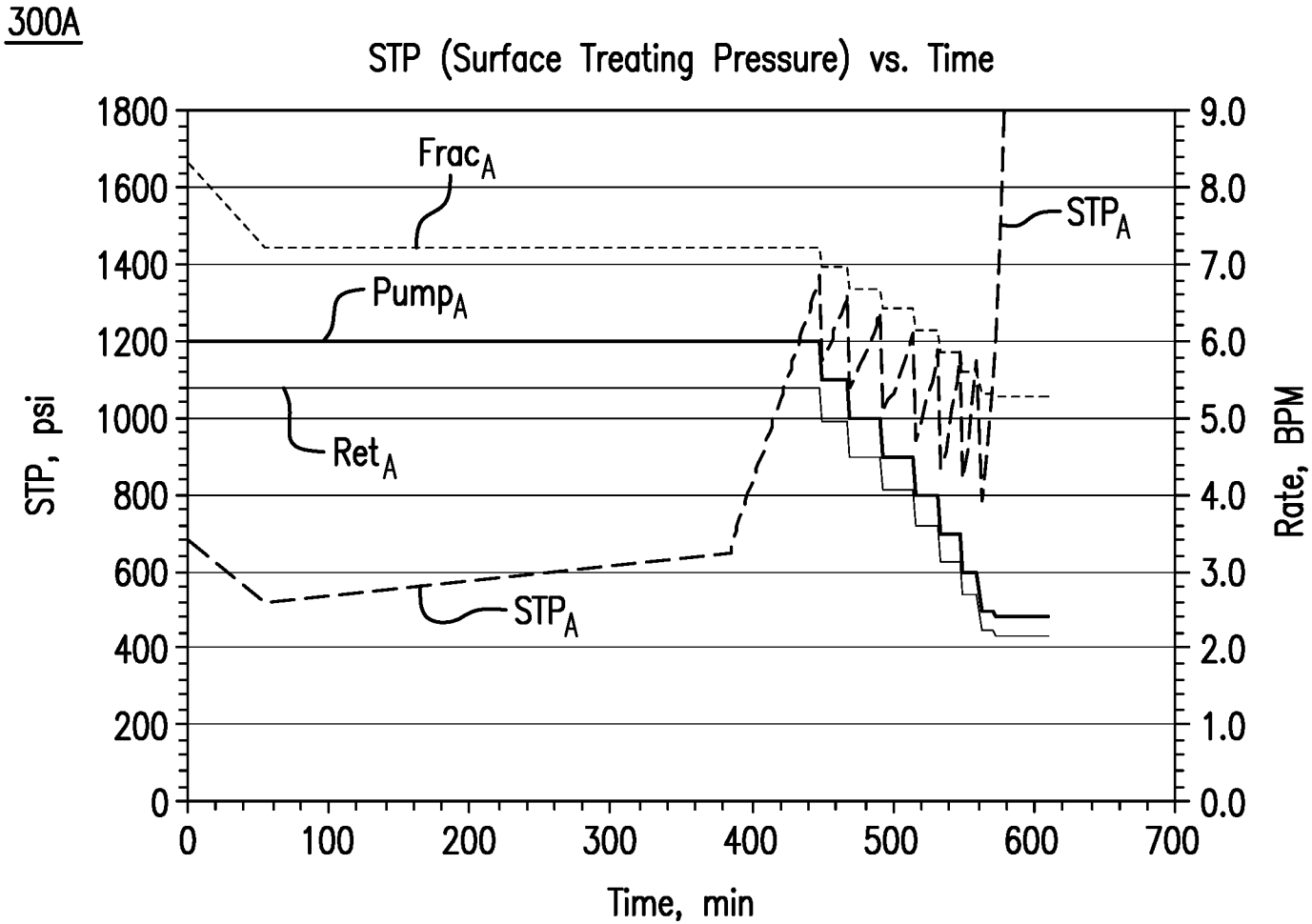
FIG. 3A is a schematic plot of pressure versus time for a typical ICD-based packing operation that does not employ embodiments of the present disclosure.
Figure 3B:
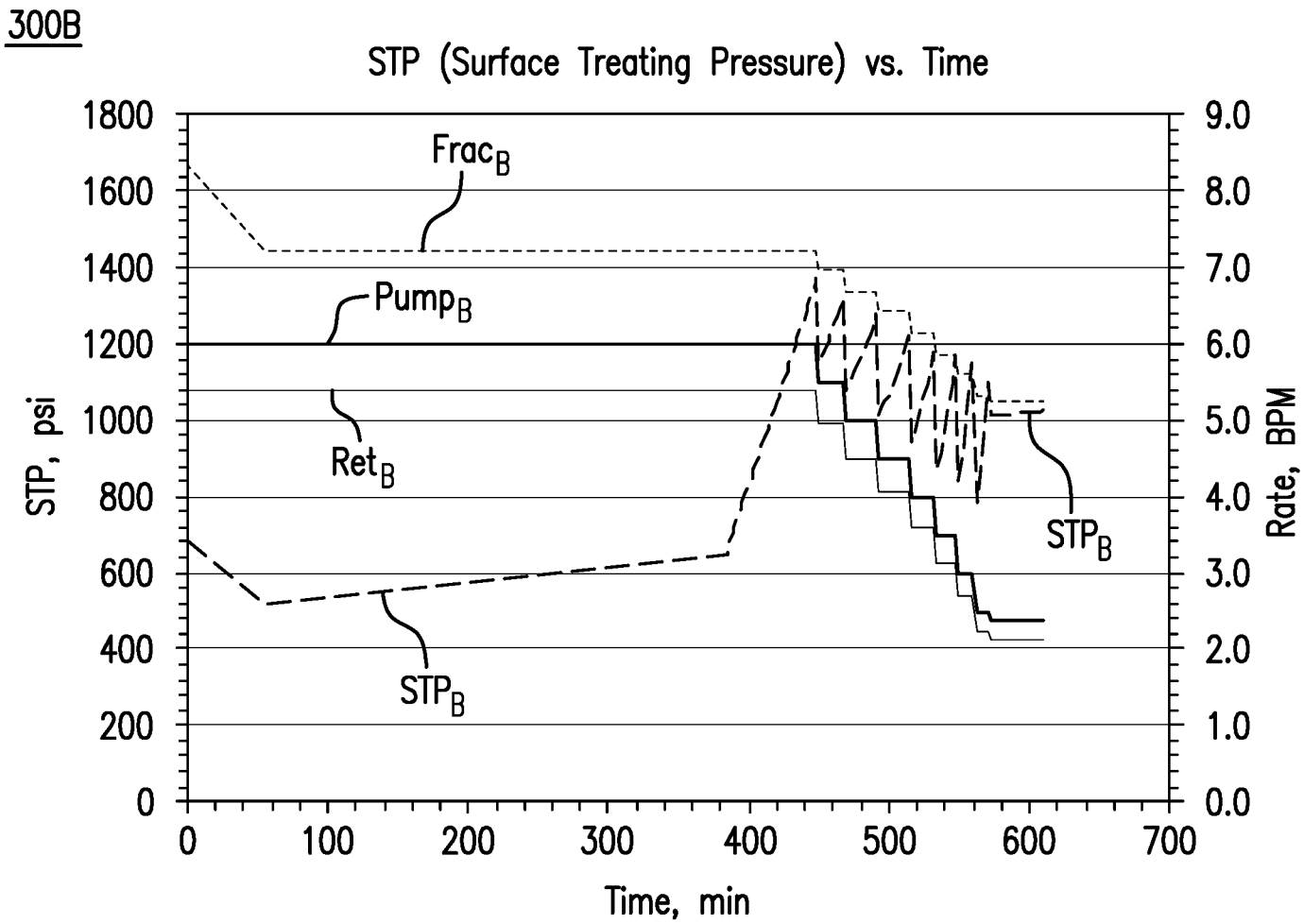
FIG. 3B is a schematic plot of pressure versus time for an ICD-based packing operation in accordance with embodiments of the present disclosure.

Turning now to FIGS. 3A-3B, schematic pressure plots 300A, 300B are shown. Plots 300A, 300B are plots of surface treating pressure (STP) as a function of time. The x-axis in both plots 300A, 300B is time in minutes, the left-hand y-axis is surface treating pressure in pounds per square inch (psi), and the right-hand y-axis is a pumping rate in barrels per minute (BPM). Each plot 300A, 300B illustrates a surface treating pressure as a function of time ($STP_A$, $STP_B$), a fracture pressure as a function of time ($Frac_A$, $Frac_B$), a pump rate as a function of time ($Pump_A$, $Pump_B$), and a return rate as a function of time ($Ret_A$, $Ret_B$). The pressure plot 300A shown in FIG. 3A is representative of an ICD-based gravel packing system that does not include a pressure activated fluid diverter of the present disclosure. In contrast, the pressure plot 300B shown in FIG. 3B is representative of a gravel pack completion system that includes a pressure activated fluid diverter at the uphole end (or start) of the ICD-based gravel packing system.

As shown in plot 300A, for a system that does not include embodiments described herein, the surface treating pressure $STP_A$ dramatically increases toward the end of the operation. When the surface treating pressure $STP_A$ increases, as shown, the pressure is too high to continue the gravel packing operation, and the job must be ended (prevents screen out). In this illustrative example operation, the early end of the operation results in about ten ICDs that are not covered with proppant placement from the beta wave. However, as shown in plot 300B, the surface treating pressure $STP_B$ remains relatively low and constant toward the end of the operation. In this illustrative example, the gravel packing operation may be continued for about an additional 30 minutes or more which enables completion of the beta-wave portion of the packing operation, and thus enabling a complete pack operation. That is, the pressure activated fluid diverter and all ICDs of the system represented in plot 300B are covered with proppant placement from the beta wave.

Figure 4:
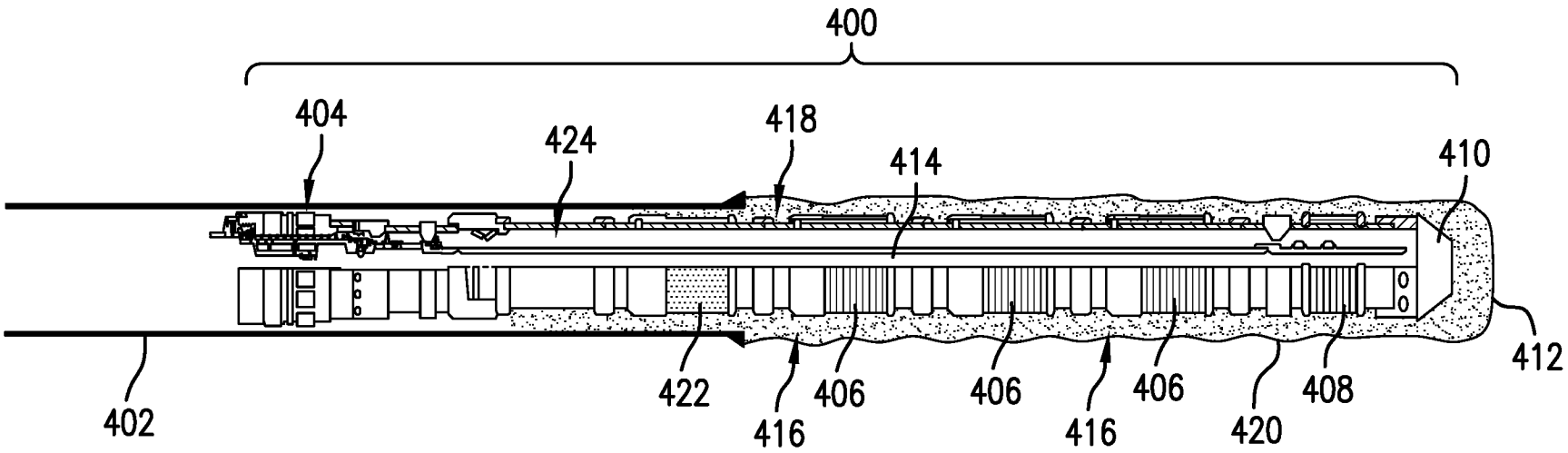
FIG. 4 is a schematic illustration of an ICD-based gravel packing system in accordance with an embodiment of the present disclosure.

Turning now to FIG. 4, a schematic illustration of an ICD-based gravel packing system 400 in accordance with an embodiment of the present disclosure is shown. The ICD-based gravel packing system 400 may be disposed on the end of a string within a casing liner 402 and includes a packer 404, a set of ICDs 406 (shown with 3 ICDs 406), a toe screen 408 at a toe of the ICD-based gravel packing system 400, and a float shoe 410 attached to the end of the toe screen 408 at the toe 412 of the borehole. During a packing operation, a washpipe 414 is arranged to pass through the string 402 and through the ICD-based gravel packing system 400 to the end proximate the float shoe 410. During a packing operation, a proppant 416 is pumped into an annulus 418 between the ICD-based gravel packing system 400 and a formation 420 (e.g., a borehole wall). The ICD-based gravel packing system 400 may further include a pressure activated fluid diverter 422 located at a top of the ICD-based gravel packing system 400. The pressure activated fluid diverter 422 may be configured to enable a flow of fluid therethrough, and into an annulus between the washpipe 414 and the ICDs 406 and/or the string 402 when a fluid pressure exceeds a predetermined pressure. That is, the pressure activated fluid diverter 422 is configured to enable a fluid flow therethrough only when a pressure of the fluid exceeds a predetermined value (particularly during a beta-wave portion of the packing operation). For example, pressure activated fluid diverter 422 may include a screen or other apertures to filter out the proppant to remain in the annulus 418 while the fluid portion is diverted in the washpipe/screen annulus 424.

As will be appreciated by those of skill in the art, the use of ICDs (inflow control devices) within gravel packing operations is intended to equalize flow along the borehole in horizontal wells to maximize oil recovery. Further, such ICD-based gravel packing systems can minimize water or gas breakthrough to increase oil production. As discussed above, when ICDs are used in sand formations requiring gravel packing, the pumping operations to circulate the proppant in place can become extremely challenging because, by nature, the ICDs choke the flowpath toward the annular space between the washpipe and the screen needed to dehydrate the slurry and prevent complete gravel pack operation. However, advantageously, by incorporating the pressure activated fluid diverter at the uphole end of the ICD-based gravel packing system, a way to reliably gravel pack using an ICD-based gravel packing systems can expand the use of ICDs, particularly for sand environments, which typically pose problems for implementation of ICD-based gravel packing systems.

The methods and systems described herein employ a pressure activated fluid diverter located as the first portion or element inside a casing section of the ICD-based gravel packing system. The pressure activated fluid diverter, in some embodiments, may be an ICD or any other device delivering a flowrate-to-fluid-pressure ratio that is one, two, or more magnitudes greater than the flowrate-to-fluid-pressure ratio characterizing the remaining ICD units in the ICD-based gravel packing system. That is, at a given fluid pressure, the pressure activated fluid diverter enables a higher flowrate therethrough than the other ICD units of the system. Alternative mechanisms for defining the nature of the pressure activated fluid diverter are described in more detail herein. The pressure activated fluid diverter at the uphole end of the ICD-based gravel packing system creates an preferential flowpath compared to the remaining ICD units and allows fluid flow inside the annulus around the washpipe (i.e., between the washpipe and the ICDs) during the final stages of the gravel pack operations (i.e., beta-wave). Advantageously, as some of the fluid is diverted, the fluid pumped in the annulus is reduced and can be handled by the ICD units to complete a complete pack of a section of borehole.

Figure 5:
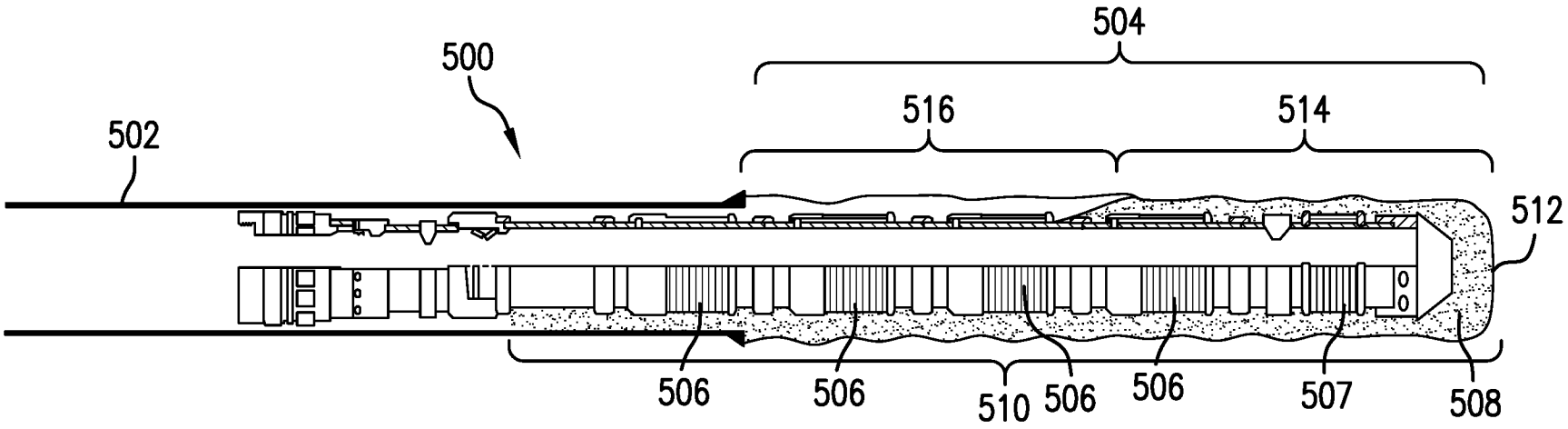
FIG. 5 is a schematic illustration of a typical ICD-based packing operation that does not employ embodiments of the present disclosure.
Figure 6:
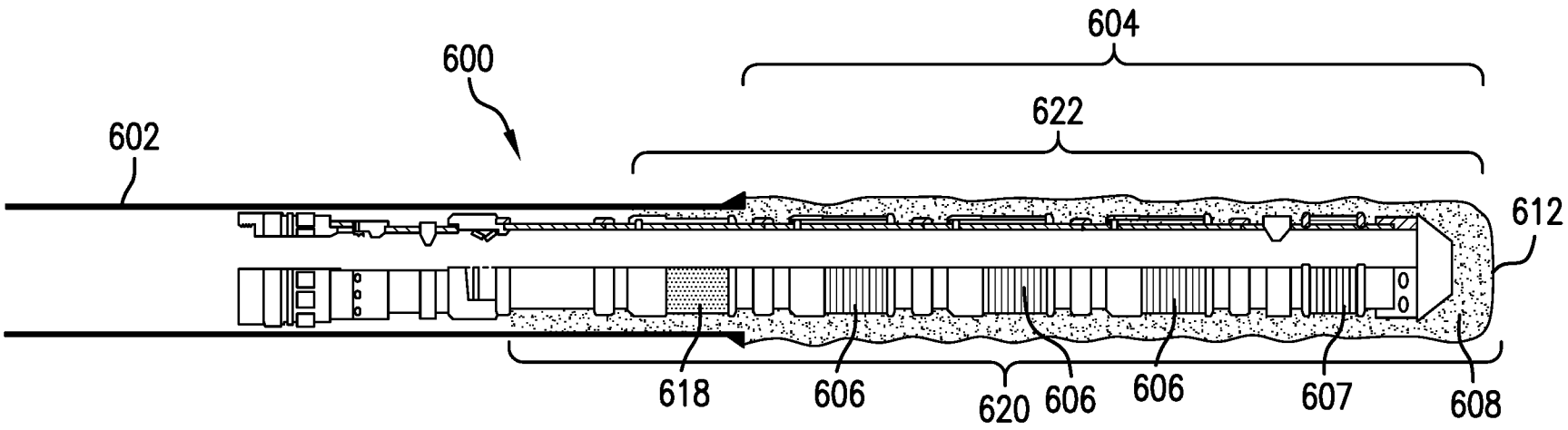
FIG. 6 is a schematic illustration of a typical ICD-based packing operation in accordance with embodiments of the present disclosure.

Turning now to FIGS. 5-6, a schematic comparison between a conventional ICD-based gravel packing system 500 (FIG. 5) and an ICD-based gravel packing system 600 (FIG. 6) in accordance with an embodiment of the present disclosure is shown. Each illustration in FIGS. 5-6 represents a completed or ended gravel-packing operation, and thus a washpipe will have been removed (and thus is not shown).

In each ICD-based gravel packing system 500, 600, the respective system is installed through a casing liner 502, 602 and extended into a section of borehole 504, 604 that does not include casing (i.e., uncased section of the borehole). As shown, each ICD-based gravel packing system 500, 600 includes a plurality of inflow control devices ("ICDs") 506, 606 configured to enable a fluid flow therethrough and thus dehydrate a proppant 508, 608 to complete the gravel packing operation, as will be appreciated by those of skill in the art. At the distal end of each ICD-based gravel packing system 500, 600 is a respective toe screen 507, 607 (which may connect to a wash pipe when installed within the ICD-based gravel packing systems 500, 600).

As shown in FIG. 5, an alpha-wave 510 of the proppant 508 will fill from an uphole end of the ICD-based gravel packing system 500 (e.g., within or proximate the casing liner 502) to a toe 512 of the uncased section of borehole 504. When the alpha-wave 510 is complete, a beta-wave 514 will be formed as a back-fill from the toe 512 toward the casing liner 502 or uphole end of the ICD-based gravel packing system 500. However, because of a lack of leakoff through the ICDs 506 during the beta-wave of the gravel packing an early screen-out of the beta-wave occurs and results in an incomplete gravel pack. This is illustrated in FIG. 5 by the incomplete pack portion 516 that is uphole from where the beta-wave 514 ends. That is, lack of leakoff through the ICD 506 during the gravel packing operation leads to early screen out of the beta wave and results in an incomplete gravel pack.

In contrast, the ICD-based gravel packing system 600 of FIG. 6 includes a pressure activated fluid diverter 618 arranged at an uphole end of the ICD-based gravel packing system 600, in accordance with an embodiment of the present disclosure. The pressure activated fluid diverter 618, as deployed (and shown), is located within the casing liner 602 and uphole of the uncased portion of the borehole 604. In this configuration, an alpha-wave 620 extends from within the casing liner 602 to the toe 612. Further, a beta-wave 622 of this configuration will extend from the toe 612 back into the casing liner 602 and provide for a complete pack of the borehole 604. The pressure activated fluid diverter 618 is configured to divert a flow during the beta-wave process and enables screen-out inside the casing and a complete gravel pack. That is, the pressure activated fluid diverter 618 inside the casing liner 602 diverts flow during the beta wave and enables screen out inside the casing liner 602 and a complete gravel pack of the uncased portion of the borehole 604. In some embodiments, the pressure activated fluid diverter 618 may be connected to a string to enable lowering of the ICD-based gravel packing system 600 into the borehole and installation thereof.

As shown, in the comparison between FIGS. 5-6, the pressure activated fluid diverter 618 replaces the most up-hole ICD of a given ICD-based gravel packing system. As such, and as shown, the ICD-based gravel packing system 500 includes four ICDs 506 and the toe screen 507. In contrast, the ICD-based gravel packing system 600 includes the pressure activated fluid diverter 618, three ICDs 606, and the toe screen 607. As such, the total length and size of the ICD-based gravel packing systems 500, 600 are substantially the same, but the ICD-based gravel packing system 600 provides for a complete gravel pack due to the inclusion of the pressure activated fluid diverter 618.

Figure 7:
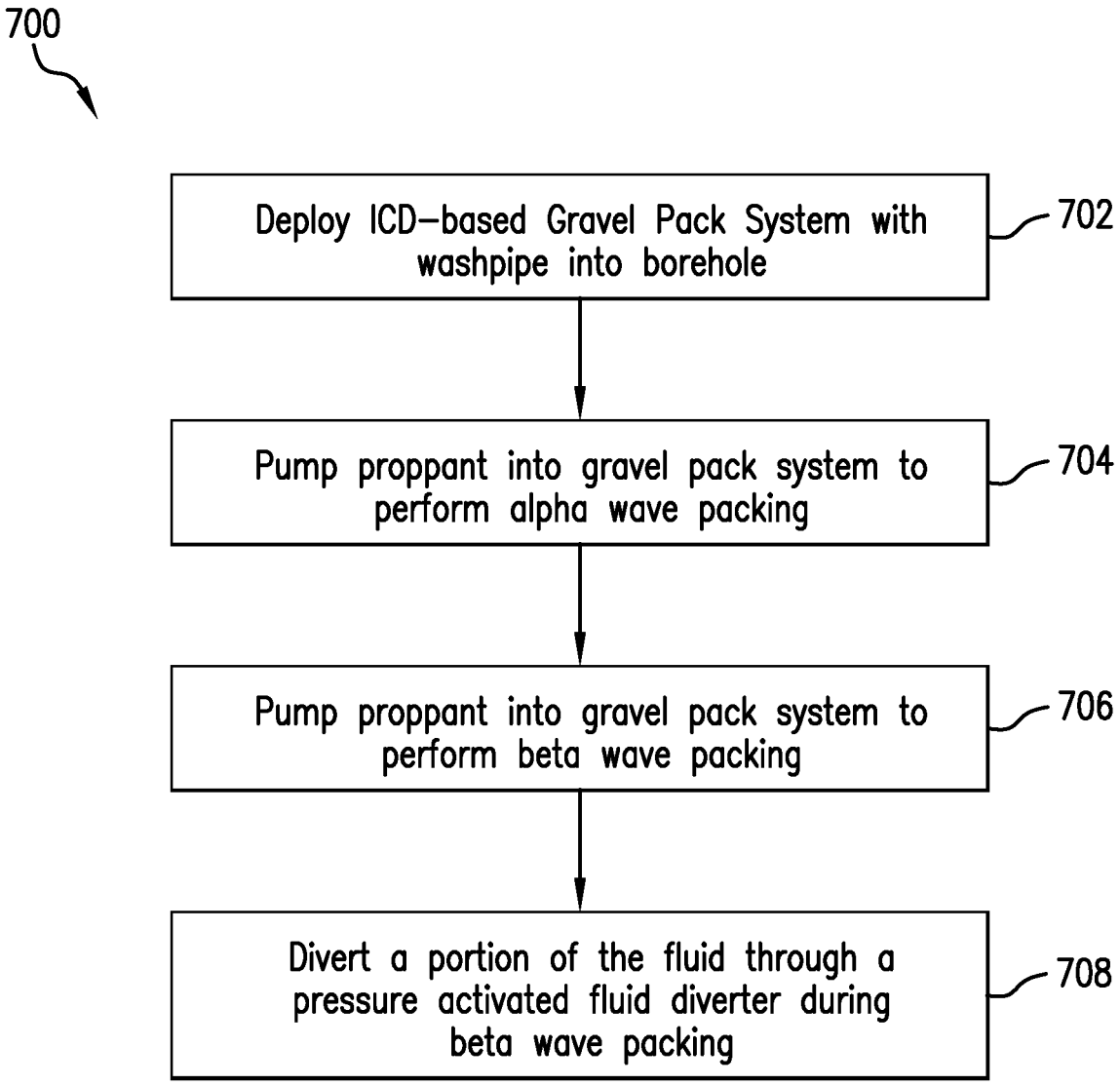
FIG. 7 is a flow process for gravel packing in accordance with an embodiment of the present disclosure.

Turning now to FIG. 7, a flow process 700 for performing a gravel pack operation in accordance with an embodiment of the present disclosure is shown. The flow process 700 may be used to perform gravel packing operations in extended reach and/or horizontal wells using and ICD-based gravel packing system (as compared to traditional screen packing systems). The flow process 700 may be, for example, implemented using an ICD-based gravel packing system as shown and described with respect to FIG. 6.

At block 702, an ICD-based gravel packing system having a washpipe is deployed into a borehole. The ICD-based gravel packing system may be installed on the end of a string that is lowered through a borehole, as will be appreciated by those of skill in the art. The ICD-based gravel packing system includes a plurality of ICDs arranged between a pressure activated fluid diverter at one end (e.g., uphole end) and a screen at the other end (e.g., downhole end). The ICD-based gravel packing system is configured to perform an alpha-beta packing operation, with an alpha-wave from uphole to downhole end and a beta-wave from downhole end to uphole end of the ICD-based gravel packing system. In some embodiments, the ICD-based gravel packing system may be lowered or installed through a section of casing and placed in an uncased section of the borehole, with the gravel packing performed to gravel pack the uncased section of the borehole. The washpipe is configured to enable a fluid to pass therethrough, such as to enable dehydration of a proppant used for a packing operation. In some embodiments, the washpipe may be installed downhole simultaneously with the ICD-based gravel packing system as a single installation process. In other embodiments, the washpipe may be installed after the ICD-based gravel packing system is placed within the borehole.

At block 704, a proppant (e.g., gravel slurry) is pumped downhole into and along the ICD-based gravel packing system to perform an alpha-wave operation. The alpha-wave operation causes the proppant to enter a borehole annulus and fill to a toe of the borehole. The alpha-wave will dune and settle such that the proppant fills a portion of an annulus around the ICD-based gravel packing system, but may not completely fill the annulus. The remaining void above the alpha-wave proppant fill must be filled prior to completion.

At block 706, proppant is continued to be pumped downhole into and along the ICD-based gravel packing system to perform a beta-wave operation. The beta-wave operation back-fills an upper (unfilled) portion or void of the borehole annulus from the toe or downhole portion of the ICD-based gravel packing system back to the start of the packing location or the uphole portion of the ICD-based gravel packing system.

At block 708, during the beta-wave operation, a portion of the proppant is diverted through a pressure activated fluid diverter to relieve fluid pressures of the packing operation during the beta-wave (block 706). Accordingly, the beta-wave may fully fill the borehole annulus and ensure a complete packing. The pressure activated fluid diverter may be a modified ICD located at the uphole end of the ICD-based gravel packing system that has a reduced flow performance curve as compared to the other ICD units of the ICD-based gravel packing system. As such, the pressure activated fluid diverter provides a fluid path of least resistance during the beta-wave operation (block 706), thus preventing over pressure events.

Figure 8:
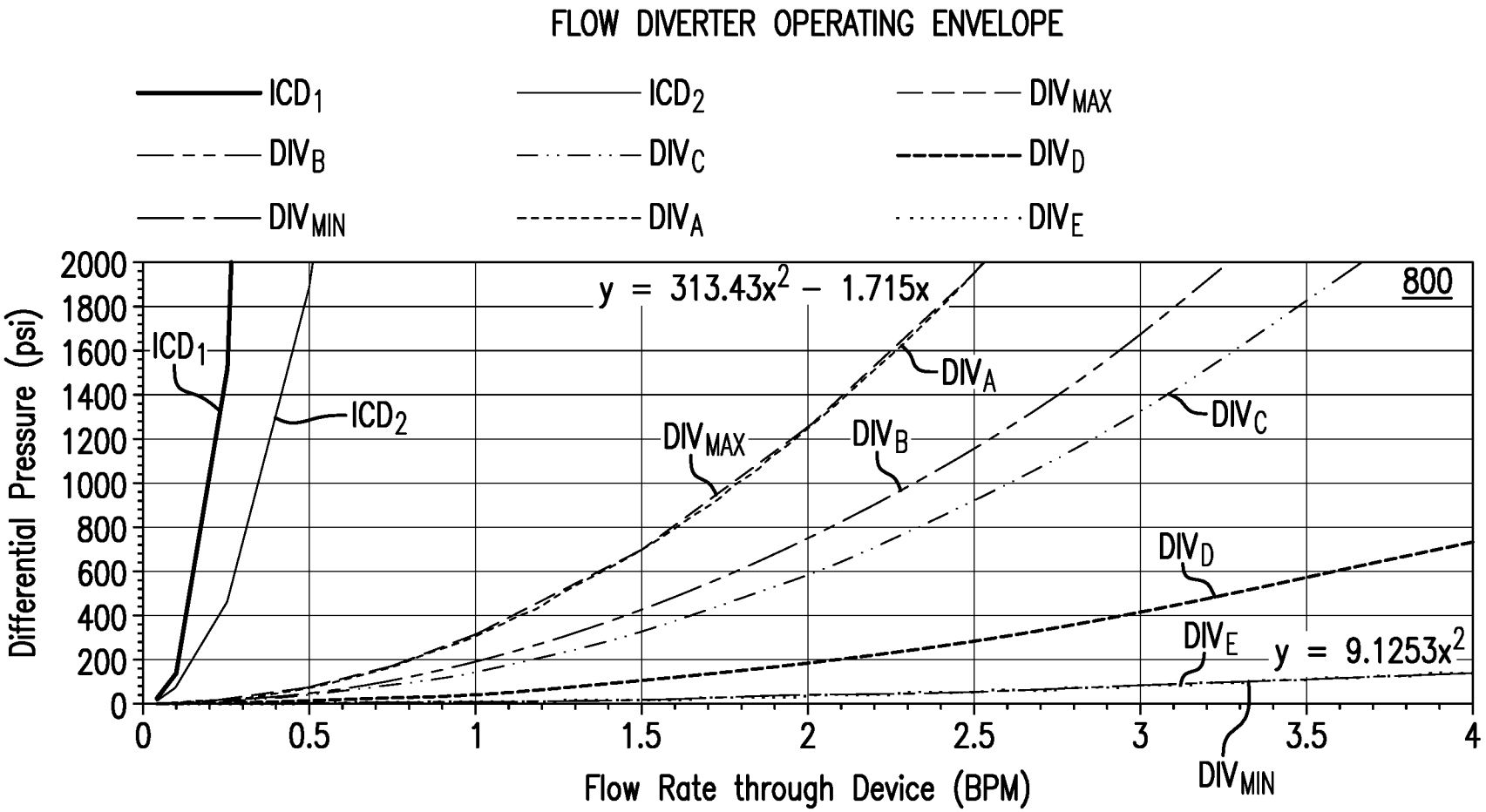
FIG. 8 is a schematic plot of flow performance curves (i.e., pressure drop as a function of pumping rate) for ICDs and pressure activated fluid diverters in accordance with an embodiment of the present disclosure.

Turning now to FIG. 8, a chart 800 illustrating different flow performance curves tools used with ICD-based gravel packing system is shown. The 800 is a representative chart of pressure drops across ICDs or pressure activated fluid diverters in accordance with the present disclosure, illustrating the flow performance curves thereof. On the horizontal axis is flow rates through the respective devices (in barrels per minute (bpm)), and on the vertical axis is the difference pressure across the device (in psi). Line $DIV_{MIN}$ represents a minimum flow performance curve across the pressure activated fluid diverter and line $DIV_{MAX}$ represents a maximum flow performance curve across the pressure activated fluid diverter in accordance with embodiments of the present disclosure. As such, the flow performance curves of the pressure activated fluid diverters of the present disclosure are flow performance curves that fall within the operating envelop, at least, below $DIV_{MAX}$. It is noted that the pressure activated fluid diverter of the present disclosure will divert some amount of fluid at any given pressure. However, the diversion and flowrate through the pressure activated fluid diverter is guided by the characteristics of the pressure activated fluid diverter to achieve a given flow performance curve. The operating envelop that is defined between line $DIV_{MIN}$ and line $DIV_{MAX}$ represents the flow-pressure space in which the flow performance curve of a given device of the present disclosure will fall. That is, the pressure activated fluid diverters of the present disclosure have flow-to-pressure characteristics within the flow-pressure space or operating envelop defined between Line $DIV_{MIN}$ and line $DIV_{MAX}$.

As shown in FIG. 8, example typical ICDs having flow performance curves $ICD_1$, $ICD_2$ are shown. As illustrated, the pressure of the ICDs increases dramatically as the flow rate through the ICDs increases. Because of this dramatic pressure increase, a gravel pack operation will be required to be stopped to prevent screen out. However, by using pressure activated fluid diverters having flow performance curves within the operating envelop defined between the minimum $DIV_{MIN}$ and the maximum $DIV_{MAX}$, a complete gravel pack may be achieved, as described above. In this example, five different flow performance curves of differently configured pressure activated fluid diverters $DIV_A$, $DIV_B$, $DIV_C$, $DIV_D$, $DIV_E$, in accordance with the present disclosure, are shown. That is, the lines of $DIV_A$, $DIV_B$, $DIV_C$, $DIV_D$, and $DIV_E$ represent flow performance curves of example pressure activated fluid diverters of the present disclosure. The different pressure activated fluid diverters may be configured with different numbers of apertures, aperture sizes, pipe supply sizes (e.g., pipe diameter), etc. to enable control and/or defining the flow performance curves. In some configurations, the pressure activated fluid diverters may be controllable to enable changing the specific flow performance curve of the pressure activated fluid diverter. For example, the number of open apertures or aperture size may be adjustable to control a flow rate through the device, and thus control the differential pressure across the device.

In accordance with some embodiments of the present disclosure, the pressure activated fluid diverters of the present disclosure are defined by a relationship between the fluid ports (e.g., apertures, nozzles, etc.) and the diameters of such fluid ports that are configured on the pressure activated fluid diverters, which can control a differential pressure at given flow rates. Such relationship may be represented by the following equation (flow performance curve):

$$DP=AQ^3+BQ^2+CQ \quad (1)$$

In equation (1), DP is the differential pressure across the device in psi (e.g., the pressure activated fluid diverter), Q is the flow rate through the device in bpm, and A, B, and C are variable coefficients. The pressure activated fluid diverters of the present disclosure are defined based on a specific fluid characteristics, when employing equation (1). Specifically, with a fluid, at room temperature, having a fluid density of 9.2 pounds per gallon (ppg) and a fluid viscosity of 1 centipoise (cps), the pressure activated fluid diverters of the present disclosure are defined as follows.

The pressure activated fluid diverters of the present disclosure are configured to have flow performance curves that satisfy equation (1) within the predefined operating envelop having an upper limit or maximum $DIV_{MAX}$ and a lower limit or minimum $DIV_{MIN}$, when a fluid as noted above is passed therethrough (i.e., at room temperature, fluid density of 9.2 ppg, and a fluid viscosity of 1 cps). The maximum $DIV_{MAX}$ is defined as having the following coefficients: A=0, B=313.43, and C=−1.715. The minimum $DIV_{MIN}$ is defined as having the following coefficients: A=0, B=9.1253, and C=0. In FIG. 8, $DIV_A$ is a flow performance curve of a pressure activated fluid diverter that is configured to satisfy equation (1) with the coefficients defined by the maximum $DIV_{MAX}$ (i.e., A=0, B=313.43, and C=−1.715). Similarly, in FIG. 8, $DIV_E$ is a flow performance curve of a pressure activated fluid diverter that is configured to satisfy equation (1) with the coefficients defined by the minimum $DIV_{MIN}$ (i.e., A=0, B=9.1253, and C=0). The other illustrated pressure activated fluid diverters ($DIV_B$, $DIV_C$, $DIV_D$) shown in FIG. 8 are representative of flow performance curves that satisfy equation (1) within the bounds of the limits defined by minimum $DIV_{MIN}$ and maximum $DIV_{MAX}$ and the associated coefficients thereof (i.e., within the operating envelop defined by $DIV_{MIN}$ and $DIV_{MAX}$). In FIG. 8, the configuration represented by $DIV_C$ can be selected for a case with the following constraints: 1000 psi maximum differential pressure across the pressure activated fluid diverter and a required 2.5 bpm final flow rate. Further, the configuration represented by $DIV_D$ can be selected for a case with the following constraints: 800 psi maximum differential pressure across the pressure activated fluid diverter and a required 4.0 bpm final flow rate.

It will be appreciated that that pressure drop across the pressure activated fluid diverter is significantly lower than that of a typical ICD (e.g., as shown in FIG. 8) as illustrated by a respective flow performance curve of the pressure activated fluid diverter. Thus, when the fluid pressure during a beta-wave reaches the flow performance curve of the pressure activated fluid diverter, the fluid flow will divert through the pressure activated fluid diverter and into a washpipe. This enables the relieving of pressure during a beta-wave operation and ensure a complete pack when using an ICD-based gravel packing system.

In some example embodiments of the present disclosure, the pressure drop of the pressure activated fluid diverters may be configured to have flow performance curves that result in 150 psi and 5,000 psi for a pumping rate of 4 bpm. In another example embodiment, the flow performance curves of pressure activated fluid diverters in accordance with the present disclosure may be configured to be between 40 psi and 1,250 psi for a pumping rate of 2 bpm. Due to these relative reduced flow performance curves of the pressure activated fluid diverters, as compared to typical ICDs, during a beta-wave operation, a portion of the fluid may be diverted through the pressure activated fluid diverter to ensure that pressures do not exceed a critical formation frac pressure and thus complete packing may be achieved.

Advantageously, embodiments of the present disclosure enable the use of ICD-based gravel packing systems in extended reach and horizontal wells. By including a pressure activated fluid diverter at an uphole point of the ICD-based gravel packing system, an alpha-wave pack followed by a beta-wave pack may be performed, without exceeding critical formation frac pressures. As such, a complete pack may be ensured even for horizontal wells and extended reach wells when using an ICD-based gravel packing system.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Embodiment 1: A downhole gravel packing system, the system comprising: a pressure activated fluid diverter; and a plurality of inflow control devices attached to the pressure activated fluid diverter to form a section of a string, wherein the pressure activated fluid diverter has an flow performance curve defined by: $DP=AQ^3+BQ^2+CQ$, wherein DP is the differential pressure across the pressure activated fluid diverter in psi and Q is the flow rate through the pressure activated fluid diverter in bpm, and wherein, with a fluid passing therethrough being at room temperature, having a fluid density of 9.2 ppg, and a fluid viscosity of 1 cps, the flow performance curve of the pressure activated fluid diverter is equal to or below a maximum flow performance curve defined by A=0, B=313.43, C=−1.715.

Embodiment 2: The downhole gravel packing system of any preceding embodiment, further comprising a screen arranged at an end of the plurality of inflow control devices opposite the pressure activated fluid diverter.

Embodiment 3: The downhole gravel packing system of any preceding embodiment, wherein a flowrate-to-fluid-pressure ratio of the pressure activated fluid diverter is at least one order of magnitude greater than a flowrate-to-fluid-pressure ratio of each of the plurality of inflow control devices.

Embodiment 4: The downhole gravel packing system of any preceding embodiment, wherein the pressure activated fluid diverter is an inflow control device.

Embodiment 5: The downhole gravel packing system of any preceding embodiment, wherein the flow performance curve of the pressure activated fluid diverter is equal to or greater than a minimum flow performance curve defined by A=0, B=9.1253, and C=0.

Embodiment 6: The downhole gravel packing system of any preceding embodiment, wherein the pressure activated fluid diverter has a flow performance curve that is below the maximum flow performance curve for flow rates of 1 to 4 bpm.

Embodiment 7: The downhole gravel packing system of any preceding embodiment, further comprising a string, wherein the pressure activated fluid diverter is connected to the string.

Embodiment 8: The downhole gravel packing system of any preceding embodiment, further comprising a casing liner a borehole in a formation, wherein the pressure activated fluid diverter is positioned within a portion of the casing.

Embodiment 9: The downhole gravel packing system of any preceding embodiment, wherein a flow performance curve of the pressure activated fluid diverter satisfies a range between 150 psi and 5,000 psi for a pumping rate of 4 bpm.

Embodiment 10: The downhole gravel packing system of any preceding embodiment, wherein a flow performance curve of the pressure activated fluid diverter satisfies a range between 40 psi and 1,250 psi for a pumping rate of 2 bpm.

Embodiment 11: A method for gravel packing a section of borehole in a formation, the method comprising: disposing a downhole gravel packing system into the borehole, the system comprising a pressure activated fluid diverter and a plurality of inflow control devices attached to the pressure activated fluid diverter to form a section of a string, wherein the pressure activated fluid diverter has a flow performance curve defined by: $DP=AQ^3+BQ^2+CQ$, wherein DP is the differential pressure across the pressure activated fluid diverter in psi and Q is the flow rate through the pressure activated fluid diverter in bpm, and wherein, with a fluid passing therethrough being at room temperature, having a fluid density of 9.2 ppg, and a fluid viscosity of 1 cps, the flow performance curve of the pressure activated fluid diverter is equal to or below a maximum flow performance curve defined by A=0, B=313.43, C=−1.715; performing an alpha pack operation to fill a section of the borehole with a proppant from the pressure activated fluid diverter to a toe of the borehole; and performing a beta pack operation to fill the section of the borehole with the proppant from the toe back to the pressure activated fluid diverter, wherein some fluid flow is diverted through the pressure activated fluid diverter when a pressure of the fluid exceeds the flow performance curve of the pressure activated fluid diverter.

Embodiment 12: The method of any preceding embodiment, wherein the downhole gravel packing system further comprises a screen arranged at an end of the plurality of inflow control devices opposite the pressure activated fluid diverter.

Embodiment 13: The method of any preceding embodiment, wherein a flowrate-to-fluid-pressure ratio of the pressure activated fluid diverter is at least one order of magnitude greater than a flowrate-to-fluid-pressure ratio of each of the plurality of inflow control devices.

Embodiment 14: The method of any preceding embodiment, wherein the pressure activated fluid diverter is an inflow control device.

Embodiment 15: The method of any preceding embodiment, wherein the pressure activated fluid diverter has a flow performance curve that is below the maximum flow performance curve for flow rates of 1 to 4 bpm.

Embodiment 16: The method of any preceding embodiment, wherein the flow performance curve of the pressure activated fluid diverter is equal to or greater than a minimum flow performance curve defined by A=0, B=9.1253, and C=0.

Embodiment 17: The method of any preceding embodiment, wherein the downhole gravel packing system is disposed downhole using a string.

Embodiment 18: The method of any preceding embodiment, wherein a portion of the borehole is lined with a casing liner and the pressure activated fluid diverter is positioned within a portion of the casing.

Embodiment 19: The method of any preceding embodiment, wherein a flow performance curve of the pressure activated fluid diverter satisfies a range between 150 psi and 5,000 psi for a pumping rate of 4 bpm.

Embodiment 20: The method of any preceding embodiment, wherein a flow performance curve of the pressure activated fluid diverter satisfies a range between 40 psi and 1,250 psi for a pumping rate of 2 bpm.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A downhole gravel packing system, the system comprising:

a pressure activated fluid diverter; and a plurality of inflow control devices attached to the pressure activated fluid diverter to form a section of a string, wherein the pressure activated fluid diverter has a flow performance curve defined by:

$$DP=AQ^3+BQ^2+CQ,$$

wherein DP is a differential pressure across the pressure activated fluid diverter in psi and Q is a flow rate through the pressure activated fluid diverter in bpm, and wherein, with a fluid passing therethrough being at room temperature, having a fluid density of 9.2 ppg, and a fluid viscosity of 1 cps, the flow performance curve of the pressure activated fluid diverter is equal to or below a maximum flow performance curve defined by A=0, B=313.43, C=−1.715.

2. The downhole gravel packing system of claim 1, further comprising a screen arranged at an end of the plurality of inflow control devices opposite the pressure activated fluid diverter.

3. The downhole gravel packing system of claim 1, wherein a flowrate-to-fluid-pressure ratio of the pressure activated fluid diverter is at least one order of magnitude greater than a flowrate-to-fluid-pressure ratio of each of the plurality of inflow control devices.

4. The downhole gravel packing system of claim 1, wherein the pressure activated fluid diverter is an inflow control device.

5. The downhole gravel packing system of claim 1, wherein the flow performance curve of the pressure activated fluid diverter is equal to or greater than a minimum flow performance curve defined by A=0, B=9.1253, and C=0.

6. The downhole gravel packing system of claim 1, wherein the pressure activated fluid diverter has a flow performance curve that is below the maximum flow performance curve for flow rates of 1 to 4 bpm.

7. The downhole gravel packing system of claim 1, further comprising a string, wherein the pressure activated fluid diverter is connected to the string.

8. The downhole gravel packing system of claim 1, further comprising a casing liner in a borehole in a formation, wherein the pressure activated fluid diverter is positioned within a portion of the casing liner.

9. The downhole gravel packing system of claim 1, wherein the flow performance curve of the pressure activated fluid diverter satisfies a range between 150 psi and 5,000 psi for a pumping rate of 4 bpm.

10. The downhole gravel packing system of claim 1, wherein the flow performance curve of the pressure activated fluid diverter satisfies a range between 40 psi and 1,250 psi for a pumping rate of 2 bpm.

11. A method for gravel packing a section of borehole in a formation, the method comprising:

disposing a downhole gravel packing system into the borehole, the system comprising a pressure activated fluid diverter and a plurality of inflow control devices attached to the pressure activated fluid diverter to form a section of a string, wherein the pressure activated fluid diverter has a flow performance curve defined by: $DP=AQ^3+BQ^2+CQ$, wherein DP is a differential pressure across the pressure activated fluid diverter in psi and Q is a flow rate through the pressure activated fluid diverter in bpm, and wherein, with a fluid passing therethrough being at room temperature, having a fluid density of 9.2 ppg, and a fluid viscosity of 1 cps, the flow performance curve of the pressure activated fluid diverter is equal to or below a maximum flow performance curve defined by A=0, B=313.43, C=−1.715;

performing an alpha pack operation to fill a section of the borehole with a proppant from the pressure activated fluid diverter to a toe of the borehole; and performing a beta pack operation to fill the section of the borehole with the proppant from the toe back to the pressure activated fluid diverter, wherein some fluid flow is diverted through the pressure activated fluid diverter when a pressure of the fluid exceeds the flow performance curve of the pressure activated fluid diverter.

12. The method of claim 11, wherein the downhole gravel packing system further comprises a screen arranged at an end of the plurality of inflow control devices opposite the pressure activated fluid diverter.

13. The method of claim 11, wherein a flowrate-to-fluid-pressure ratio of the pressure activated fluid diverter is at least one order of magnitude greater than a flowrate-to-fluid-pressure ratio of each of the plurality of inflow control devices.

14. The method of claim 11, wherein the pressure activated fluid diverter is an inflow control device.

15. The method of claim 11, wherein the pressure activated fluid diverter has a flow performance curve that is below the maximum flow performance curve for flow rates of 1 to 4 bpm.

16. The method of claim 11, wherein the flow performance curve of the pressure activated fluid diverter is equal to or greater than a minimum flow performance curve defined by A=0, B=9.1253, and C=0.

17. The method of claim 11, wherein the downhole gravel packing system is disposed downhole using a string.

18. The method of claim 11, wherein a portion of the borehole is lined with a casing liner and the pressure activated fluid diverter is positioned within a portion of the casing.

19. The method of claim 11, wherein the flow performance curve of the pressure activated fluid diverter satisfies a range between 150 psi and 5,000 psi for a pumping rate of 4 bpm.

20. The method of claim 11, wherein the flow performance curve of the pressure activated fluid diverter satisfies a range between 40 psi and 1,250 psi for a pumping rate of 2 bpm.

* * * * *